US010482819B2

(12) United States Patent
Nebon et al.

(10) Patent No.: US 10,482,819 B2
(45) **Date of Patent: *Nov. 19, 2019**

(54) DEVICE WITH OLED MATRIX OF ACTIVE PIXELS WITH CATHODE VOLTAGE REGULATION, AND CORRESPONDING METHOD

(71) Applicant: STMicroelectronics International N.V., Schiphol (NL)

(72) Inventors: Jerome Nebon, Seyssins (FR); Jean-Marie Permezel, Grenoble (FR)

(73) Assignee: STMicroelectronics International N.V., Schiphol (NL)

( * ) Notice: Subject to any disclaimer, the term of this patent is extended or adjusted under 35 U.S.C. 154(b) by 88 days.

This patent is subject to a terminal disclaimer.

(21) Appl. No.: 15/809,007

(22) Filed: Nov. 10, 2017

(65) Prior Publication Data

US 2018/0090060 A1 Mar. 29, 2018

Related U.S. Application Data

(63) Continuation of application No. 14/730,928, filed on Jun. 4, 2015, now Pat. No. 9,847,059.

(30) Foreign Application Priority Data

Jul. 8, 2014 (FR) ..... 14 56579

(51) Int. Cl.
*G09G 3/325* (2016.01)
*G09G 3/3225* (2016.01)
(Continued)

(52) U.S. Cl.
CPC ..... *G09G 3/325* (2013.01); *G09G 3/3225* (2013.01); *G09G 3/3266* (2013.01);
(Continued)

(58) Field of Classification Search
CPC .... G09G 3/325; G09G 3/3225; G09G 3/3266; G09G 3/3275
See application file for complete search history.

(56) References Cited

U.S. PATENT DOCUMENTS 9,847,059 B2 * 12/2017 Nebon ..... G09G 3/325
2004/0196049 A1 10/2004 Yano et al.
(Continued)

OTHER PUBLICATIONS

INPI Search Report and Written Opinion for FR 1456579 dated Jan. 21, 2015 (7 pages).

*Primary Examiner* — Kevin M Nguyen
(74) *Attorney, Agent, or Firm* — Crowe & Dunlevy

(57) ABSTRACT

A device includes a matrix of active pixels, with each active pixel having an OLED diode having a cathode to receive a cathode voltage, and a control circuit coupled to an anode of the OLED diode. The device also includes at least one dummy pixel having a dummy OLED diode having a cathode to receive the cathode voltage, and an anode, and a dummy control circuit coupled to the anode of the OLED diode and having a power supply terminal. The dummy OLED diode and the dummy control circuit are substantially similar to the OLED diode and the control circuit. First regulation circuitry is configured to deliver a reference current to the power supply terminal to thereby generate a voltage, and second regulation circuitry is configured to regulate the cathode voltage so as to maintain the voltage at the power supply terminal at a given level.

17 Claims, 2 Drawing Sheets

(51) Int. Cl.
*G09G 3/3266* (2016.01)
*G09G 3/3275* (2016.01)

(52) U.S. Cl.
CPC ... *G09G 3/3275* (2013.01); *G09G 2300/0413* (2013.01); *G09G 2300/08* (2013.01); *G09G 2300/0866* (2013.01); *G09G 2320/041* (2013.01)

(56) References Cited

U.S. PATENT DOCUMENTS

| | | | |
|---|---|---|---|
| 2005/0068270 | A1 | 3/2005 | Awakura et al. |
| 2006/0022206 | A1 | 2/2006 | Hayakawa et al. |
| 2006/0038501 | A1 | 2/2006 | Koyama et al. |
| 2008/0012801 | A1 | 1/2008 | Kimura et al. |
| 2008/0290806 | A1 | 11/2008 | Tada et al. |
| 2011/0298396 | A1 | 12/2011 | Kimura |
| 2014/0085284 | A1 | 3/2014 | Sun et al. |

* cited by examiner

DEVICE WITH OLED MATRIX OF ACTIVE PIXELS WITH CATHODE VOLTAGE REGULATION, AND CORRESPONDING METHOD

CROSS REFERENCE TO RELATED APPLICATIONS

This application is a continuation of U.S. application for patent Ser. No. 14/730,928 filed Jun. 4, 2015 which claims the benefit and priority of French Application No. 1456579, filed Jul. 8, 2014, the disclosures of which are hereby incorporated by reference.

TECHNICAL FIELD

Implementations and embodiments according to this disclosure relate to devices equipped with a matrix or matrices of active OLED pixels, and more specifically the cathode voltage of the OLED diodes of these matrices.

BACKGROUND

Devices are known from the prior art that have matrices of active pixels, in which each pixel comprises an OLED diode and a control circuit constructed from transistors. In these matrices, the cathodes of the OLED diodes are coupled together to receive a cathode voltage, for example a negative voltage.

The OLED diodes exhibit a voltage threshold which can vary with temperature. To obtain a light image which is unaffected by temperature, it has been proposed to use a temperature sensor, and to use the measured temperature value to generate a cathode voltage which makes it possible to maintain the light emission despite the temperature variation.

This approach presents a variety of drawbacks. For example, a calibration step after the fabrication of each device is used to associate the temperature values with the corresponding cathode voltage levels and with the luminosity levels. This step can be time consuming, and the temperature sensors used may not be sufficiently accurate with an inaccuracy on the order of a few degrees. The circuitry used to generate a cathode voltage may not be sufficiently accurate, and the use of a single temperature sensor provides information relating to the temperature at but a single point.

Therefore, further developments in devices with matrices of active OLED pixels capable of compensating for temperature are desired.

SUMMARY

According to one implementation and embodiment, a device includes a pixel configured to receive a cathode voltage, and a dummy pixel coupled between a power supply terminal and the cathode voltage, the dummy pixel being substantially similar to the pixel. A reference current generator is coupled to the power supply terminal to apply a reference current thereto, causing generation of a reference voltage. A voltage regulator is configured to generate the cathode voltage so as to maintain the reference voltage at a threshold level.

According to one implementation and embodiment, it is proposed to generate a cathode voltage that is better matched to the temperature of the device, that is to say that makes it possible to have a desired luminosity, and to generate that cathode voltage without the use of a temperature sensor.

According to one aspect, a device is proposed that includes a matrix of active pixels, each active pixel being an OLED diode, the cathode of which is intended to receive a cathode voltage. A control circuit coupled to the anode of the OLED diode.

According to a general feature of this aspect, the device includes at least one dummy pixel which is an OLED diode, the cathode of which is intended to receive the cathode voltage, and a dummy control circuit coupled to the anode of the OLED diode and having a power supply terminal. First circuitry is configured to deliver a reference current to the power supply terminal, and second regulation circuitry is configured to regulate the cathode voltage so as to maintain a reference voltage at the power supply terminal.

Thus, no temperature sensor is used, and the cathode voltage is regulated with an aim toward maintaining the pair formed by the reference current and the reference voltage. Since the reference current is supplied constantly, it is the voltage at the power supply terminal which is observed and maintained by acting on the cathode voltage.

Upon a temperature rise, the threshold voltage of the OLED diode of the dummy pixel decreases. The voltage measured at the lower supply terminal also decreases. The cathode voltage of the OLED diode, which is biased with a negative potential, decreases as an absolute value. To have a constant current flow in the OLED diode, which results in a constant luminosity, the cathode voltage is increased in absolute value.

Also, by using a dummy pixel which includes a control circuit and an OLED diode, it is possible to observe on this circuit the same impact that the temperature has on a pixel of the matrix of active OLED pixels. "Dummy pixel" should be understood to mean a pixel which is not used for the display of an image by the matrix of active pixels, but which includes an OLED diode and a control circuit.

The at least one dummy pixel can be arranged at the periphery of the matrix of active pixels. Advantageously, the device can have a plurality of dummy pixels with their power supply terminals coupled together.

The reference current value is then chosen to correspond to the product of the number of dummy pixels and of the current required by one pixel. It is easier to provide a higher current value, and the accuracy of the device is therefore enhanced with a plurality of dummy pixels.

Furthermore, by using a plurality of dummy pixels, the effect of the temperature is taken into account over a greater number of dummy pixels which are not all positioned in the same place but which can be arranged around the matrix of active pixels. The temperature variations at a higher number of points are thus taken into account and the device is therefore more accurate.

The device also has second circuitry including an analog-to-digital converter with an input configured to receive the voltage at the power supply terminal(s), third circuitry configured to compare the reference voltage with the output of the analog-to-digital converter, and fourth circuitry configured to generate the cathode voltage from the output of the third circuitry.

The reference current value and the reference voltage value can be chosen for the OLED diode of the at least one dummy pixel to supply a reference luminosity. It will be possible, for example, to choose a reference luminosity which can be easily maintained. Such a reference luminosity is different from black. It can be noted that it is easier to maintain a luminosity which corresponds to a current that is high enough to be controlled.

The device can be used to determine the cathode voltage at certain moments so as not to disrupt the light emission. It is possible to determine the cathode voltage at regular intervals.

According to another aspect, there is proposed a method for regulating a cathode voltage of an OLED diode of an OLED matrix of active pixels, each active pixel having an OLED diode, the cathode of which is intended to receive the cathode voltage and a control circuit coupled to the anode of the OLED diode.

According to one feature of this aspect, the method includes a delivery of a reference current to a power supply terminal of at least one dummy pixel having an OLED diode, the cathode of which is intended to receive the cathode voltage and a dummy control circuit coupled to the anode of the OLED diode and having the power supply terminal. The method also includes a regulation of the cathode voltage so as to maintain a reference voltage at the power supply terminal.

The reference current can be delivered to a plurality of power supply terminals of a plurality of dummy pixels having their power supply terminals coupled together.

The regulation of the voltage applied to the negative power supply line can include an analog-to-digital conversion of the voltage at the power supply terminal(s), a comparison of the reference voltage with the value obtained by the analog-to-digital conversion, and a generation of the cathode voltage from the result of the comparison.

The reference current value and the reference voltage value can be chosen for the OLED diode of the at least one dummy pixel to supply a reference luminosity.

BRIEF DESCRIPTION OF THE DRAWINGS

Other advantages and features will become apparent on examining the detailed description of nonlimiting implementations and embodiments, and the attached drawings in which.

DETAILED DESCRIPTION

One or more embodiments will be described below. These described embodiments are only examples of implementation techniques, as defined solely by the attached claims. Additionally, in an effort to provide a focused description, irrelevant features of an actual implementation may not be described in the specification.

Figure 1:
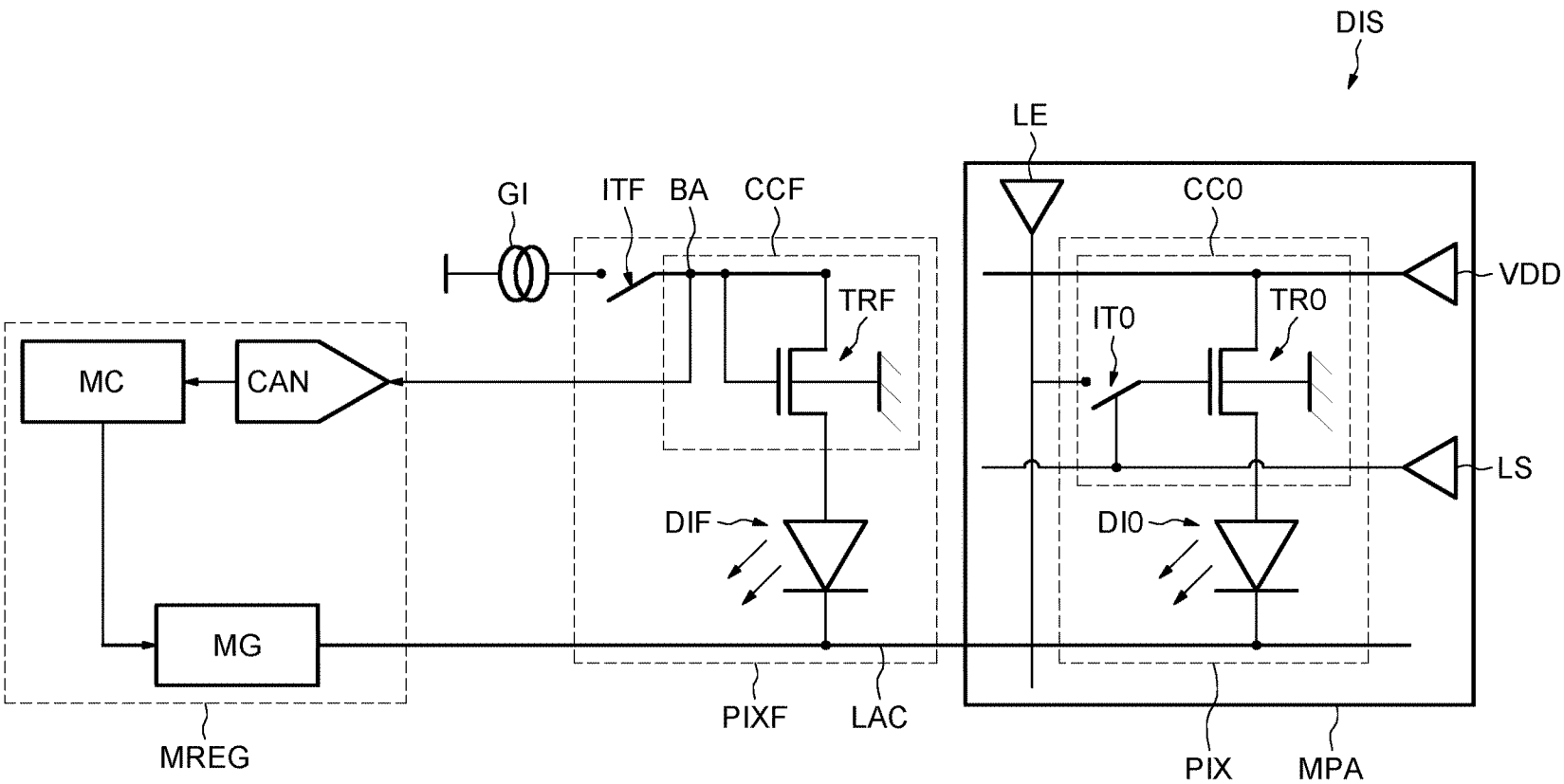
FIG. 1 is a diagram of a device according to one embodiment.

In FIG. 1, a device DIS is represented comprising a matrix of active pixels MPA. The matrix of active pixels comprises active pixels PIX provided with an OLED diode DI0 and a control circuit CC0. The OLED diode DI0 has its cathode coupled to a cathode power supply line LAC which is intended to receive a cathode voltage. The anode of the OLED diode DI0 is coupled to the control circuit CC0, and more specifically to the source of transistor TR0 which has its drain coupled to a power supply line VDD. Upon the refreshing of a pixel PIX, a voltage is applied to the gate of this transistor TR0 by controlling a switch IT0, and this voltage is maintained by virtue of the capacitor formed by the gate and the substrate of the transistor TR0. The switch IT0 is controlled by a selection line LS to switch this voltage from a sampling line LE to the gate of the transistor TR0.

For the purposes of simplification, a single active pixel PIX of the matrix of pixels MPA has been represented, but it should be understood that the OLED matrix of active pixels MPA includes a plurality of pixels PIX organized in rows and in columns.

To generate the cathode voltage to be applied to the cathode power supply line of the pixels PIX, the device comprises a dummy pixel PIXF, first circuitry GI configured to deliver a reference current, and regulation circuitry MREG configured to regulate the cathode voltage so as to maintain a reference voltage at the power supply terminal.

As can be seen in FIG. 1, the dummy pixel PIXF is arranged outside of the matrix of active pixels MPA, at the periphery of this matrix.

The dummy pixel PIXF comprises a dummy control circuit CCF and an OLED diode DIF, the cathode of which is coupled to the cathode power supply line LAC and is therefore intended to receive the cathode voltage. The control circuit CCF of the dummy pixel PIXF comprises a transistor TRF, the source of which is coupled to the anode of the OLED diode DIF. The drain and the gate of the transistor TRF are coupled together at a power supply terminal BA, which can receive, via a switch ITF, a current delivered by the first circuitry GI configured to deliver a reference current. The first circuitry GI can be a current generator.

The appearance of a current at the power supply terminal of a transistor causes a voltage to appear which controls the gate of the transistor TRF to make the transistor TRF conduct, and the current flows through the transistor to the diode DIF.

When the switch ITF is closed and a reference current is delivered to the power supply terminal BA, to generate the cathode voltage, the voltage can be measured at the power supply terminal. To this end, the regulation circuitry MREG for regulating the cathode voltage comprises second circuitry including an analog-to-digital converter CAN. Third circuitry MC is configured to compare the reference voltage with the output of the analog-to-digital converter CAN, and fourth circuitry MG is configured to generate the cathode voltage from the output of the third circuitry.

The analog-to-digital converter CAN generates a digital value from the voltage measured at the power supply terminal BA. This digital value is compared to a reference value within the circuitry MC which can comprise a logic circuit and memories.

At the output of the circuitry MC, a digital value is obtained which corresponds to the new cathode voltage value to be applied. This value is determined in such a way that the voltage measured at the power supply terminal BA is maintained around a reference value which corresponds with the reference current value delivered, to a chosen luminosity value. A voltage variation is thus taken into account whereas, in the prior art, it is a temperature variation measured by a sensor which is taken into account.

The fourth circuitry MG configured to generate the cathode voltage from the output of the third circuitry comprises a voltage generator coupled to the cathode power supply line LAC.

Figure 2:
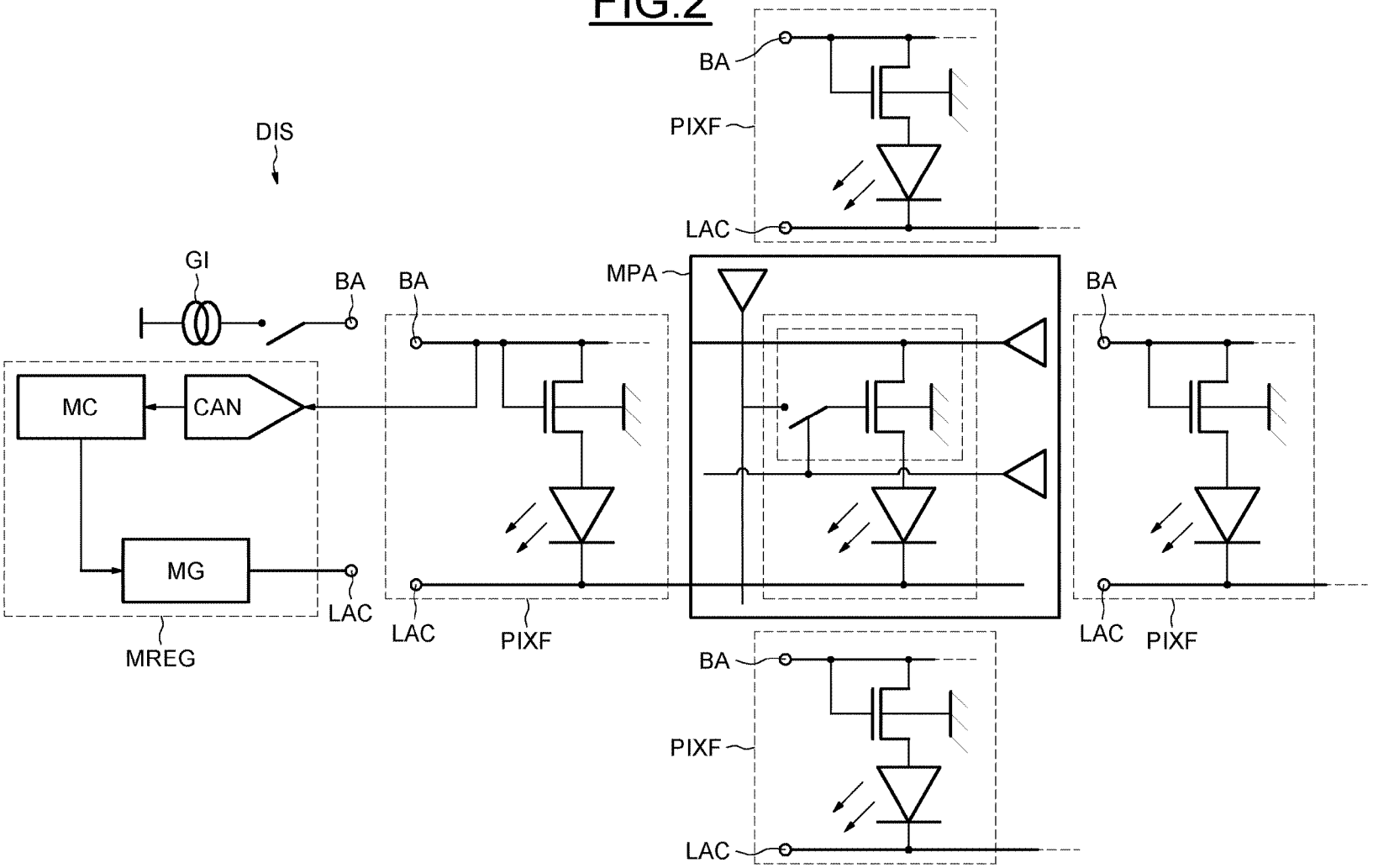
FIG. 2 is a diagram of a device according to another embodiment.

FIG. 2 shows a diagram of another device DIS which has several dummy pixels PIXF. In this FIG. 2 four dummy pixels PIXF have been represented around the matrix of active pixels MPA. The pixels PIXF are distributed evenly around the matrix of pixels PIXF and their number can, for example, be on the order of several hundred. The increase in the number of dummy pixels PIXF makes it possible to improve the accuracy of the device, since the temperature variations at a plurality of points are taken into account. The accuracy of the device is also improved because the reference current corresponds to the product of the reference current of one dummy pixel by the number of dummy pixels PIXF. This makes it possible to correctly take into account the temperature variations and therefore obtain a well-controlled luminosity. It can be noted that the power supply terminals BA are intercoupled, and such is also the case with the power supply lines LAC.

According to one aspect, the devices described herein make it possible to take into account the temperature in a more accurate manner to control the luminosity of an OLED pixel matrix.

The technology described herein also makes it possible to simplify the calibration of the device for which there is no need to measure the temperature, the cathode voltage, and the luminosity during calibration phases. Here, the selection of a reference current/reference voltage pair with an associated luminosity makes it possible to calibrate the device. A faster calibration phase is thus obtained.

While the disclosure has been described with respect to a limited number of embodiments, those skilled in the art, having benefit of this disclosure, will appreciate that other embodiments can be envisioned that do not depart from the scope of the disclosure as disclosed herein. Accordingly, the scope of the disclosure shall be limited only by the attached claims.

The invention claimed is:

1. A device, comprising:

a matrix of active pixels, each active pixel comprising:
- a control circuit coupled to an anode side terminal; and
- an OLED diode having an anode coupled to the control circuit and a cathode coupled to a cathode supply line;

at least one dummy pixel comprising:
- a dummy control circuit; and
- a dummy OLED diode having an anode coupled to the dummy control circuit and a cathode coupled to the cathode supply line;
- wherein the dummy OLED diode has substantially similar operating characteristics as the OLED diode, and the dummy control circuit has substantially similar operating characteristics as the control circuit;

a current source;

a switch having a first terminal coupled to the current source and a second terminal coupled to the anode side terminal;

wherein the dummy control circuit is coupled between the second terminal of the switch and the anode of the dummy OLED diode; and regulation circuitry coupled between the anode side terminal and the cathode supply line.

2. The device of claim 1, wherein the control circuit comprises a transistor having a source coupled to the anode of the OLED diode, a drain coupled to a supply voltage, and a gate coupled to a refresh switch.

3. The device of claim 2, wherein the dummy control circuit comprises a transistor having a source coupled to the anode of the dummy OLED diode, a drain coupled to the anode side terminal, and a gate coupled to the anode side terminal; and wherein the transistor of the dummy control circuit is a replica of the transistor of the control circuit.

4. The device of claim 2, wherein the refresh switch is controlled by a sampling line.

5. The device of claim 1, wherein the at least one dummy pixel is arranged at a periphery of the matrix of active pixels.

6. The device of claim 1, wherein the at least one dummy pixel comprises a plurality of dummy pixels arranged about a periphery of the matrix of active pixels.

7. The device of claim 6, wherein the plurality of dummy pixels includes at least one dummy pixel at each peripheral side of the matrix of active pixels.

8. The device of claim 1, wherein the regulation circuitry comprises:

an analog to digital converter receiving input from the anode side terminal;

comparison circuitry receiving inputs from output of the analog to digital converter and a reference voltage; and cathode voltage generation circuitry receiving input from output of the comparison circuitry, and generating a voltage on the cathode supply line based thereupon.

9. A device, comprising:

a matrix of active pixels each coupled between a supply voltage and a cathode supply line;

a plurality of dummy pixels arranged outside of the matrix of active pixels and about a periphery of the matrix of active pixels;

a current source generating a reference current;

a switch having a first terminal coupled to the current source and a second terminal coupled to the anode side terminal;

wherein each of the plurality of dummy pixels includes:
- a transistor having a first conduction terminal coupled to the second terminal of the switch, and a second conduction terminal; and
- a dummy OLED diode having an anode coupled to the second conduction terminal of the transistor and a cathode coupled to the cathode supply line; and regulation circuitry configured to sense a voltage at the anode side terminal and, based thereupon, generate a cathode voltage on the cathode supply line so as to maintain the voltage at the anode side terminal at a reference voltage.

10. The device of claim 9, wherein the regulation circuitry comprises:

an analog-to-digital converter having an input receiving the voltage at the anode side terminal and digitizing the voltage at the anode side terminal;

a comparator configured to compare the reference voltage with the digitized voltage; and cathode voltage generation circuitry configured to generate the cathode voltage as a function of output of the comparator so as to maintain a constant current flow through the matrix of active pixels.

11. The device of claim 9, wherein the plurality of dummy pixels includes at least one dummy pixel at each peripheral side of the matrix of active pixels.

12. The device of claim 9, wherein the regulation circuitry regulates the voltage at the anode side terminal without receiving a signal from a temperature sensor.

13. A method, comprising:

selectively delivering a reference current to a switch having a first terminal coupled to a current source and a second terminal coupled to an anode side terminal associated with at least one dummy pixel comprising an OLED diode with a cathode terminal configured to receive a cathode voltage and an anode coupled to a dummy control circuit that is coupled between the second terminal of the switch and the anode of the OLED diode of the at least one dummy pixel, the at least one dummy pixel being substantially similar to an active pixel; and varying the cathode voltage so as to maintain a substantially constant current flow through the at least one dummy pixel.

14. The method of claim 13, wherein the cathode voltage is varied so as to maintain a voltage at the anode side terminal at a reference voltage.

15. The method of claim 14, wherein the varying of the cathode voltage is performed based upon a comparison of the voltage at the anode side terminal to the reference voltage.

16. The method of claim 15, wherein the varying of the cathode voltage is performed by digitizing the voltage at the anode side terminal, comparing the digitized voltage to a digitized reference voltage, decreasing the cathode voltage if the digitized voltage is less than the digitized reference voltage, and increasing the cathode voltage if the digitized voltage is greater than the digitized reference voltage.

17. The method of claim 13, wherein the varying of the cathode voltage is performed without receiving temperature data.

* * * * *